US006293039B1

(12) United States Patent
Fuchs

(10) Patent No.: US 6,293,039 B1
(45) Date of Patent: Sep. 25, 2001

(54) PISTOL WITH LOCKING MECHANISM

(75) Inventor: Rudolf Fuchs, Thayngen (CH)

(73) Assignee: SIG Arms International AG (CH)

( * ) Notice: Subject to any disclaimer, the term of this patent is extended or adjusted under 35 U.S.C. 154(b) by 0 days.

(21) Appl. No.: 09/246,050

(22) Filed: Feb. 8, 1999

(30) Foreign Application Priority Data

Feb. 10, 1998 (DE) ..... 198 05 306

(51) Int. Cl.[7] ..... F41A 17/04
(52) U.S. Cl. ..... 42/70.11; 42/70.07; 42/70.04
(58) Field of Search ..... 42/70.11, 70.01, 42/70.05, 70.07, 70.08, 70.04

(56) References Cited

U.S. PATENT DOCUMENTS

| | | | | |
|---|---|---|---|---|
| 3,735,519 | * | 5/1973 | Fox | 42/70.04 |
| 4,457,091 | | 7/1984 | Wallerstein | 42/1 LP |
| 4,467,545 | * | 8/1984 | Shaw, Jr. | 42/70 R |
| 4,739,569 | | 4/1988 | Battle | 42/1.01 |
| 4,970,819 | | 11/1990 | Mayhak | 42/70.01 |
| 5,022,175 | | 6/1991 | Oncke et al. | 42/70.11 |
| 5,062,232 | | 11/1991 | Eppler | 42/70.11 |
| 5,448,847 | * | 9/1995 | Teetzel | 42/70.06 |
| 5,461,812 | * | 10/1995 | Bennett | 42/70.06 |
| 5,502,915 | | 4/1996 | Mendelsohn et al. | 42/70.11 |
| 5,560,135 | * | 10/1996 | Ciluffo | 42/70.07 |
| 5,603,179 | * | 2/1997 | Adams | 42/70.08 |
| 5,636,464 | | 6/1997 | Ciluffo | 42/70.11 |
| 5,946,841 | * | 9/1999 | Roper | 42/70.07 |

FOREIGN PATENT DOCUMENTS

| | | | |
|---|---|---|---|
| 4303333 | 6/1994 | (DE) | F41A/17/06 |

* cited by examiner

*Primary Examiner*—J. Woodrow Eldred
(74) *Attorney, Agent, or Firm*—Webb Ziesenheim Logsdon Orkin & Hanson, P.C.

(57) ABSTRACT

A pistol has a locking mechanism that locks the trigger mechanism of the pistol if an unauthorized person attempts to fire the pistol. The locking mechanism includes an identification unit to detect an identification signal and a control unit that compares the inputted signal with a stored identification pattern. An electromechanical actuator device actuates a locking element that can be moved into a locked position and into an unlocked position, which in the locked position locks the trigger tongue of the pistol. The pistol locking mechanism has a plurality of display elements that display the operating status of the locking mechanism.

19 Claims, 2 Drawing Sheets

PISTOL WITH LOCKING MECHANISM

BACKGROUND OF THE INVENTION

1. Field of the Invention

This invention relates to handguns and, more particularly, to a pistol having a locking mechanism to lock and unlock the pistol trigger mechanism.

2. Description of the Currently Available Technology

U.S. Pat. No. 5,502,915 describes a revolver that includes a locking device that blocks the hammer if an attempt to operate the revolver is made by an unauthorized person. The device has a scanner on the revolver grip that identifies the palm print of the shooter and compares it to a pattern stored in memory. If the scanned print matches the print stored in memory, the hammer is unlocked by a solenoid so that the weapon is ready for firing. However, this solution cannot be used on most automatic pistols since the magazine must be inserted into the pistol grip and, therefore, there would be no room for the locking device.

Additional locking devices for handguns that can be fired only by authorized users are described in DE-A-43 03 333 and U.S. Pat. Nos. 5,603,179; 5,022,175; and 4,970,819.

Therefore, it is an object of the invention to create a locking mechanism for a pistol, e.g., an automatic pistol, that locks the trigger mechanism of the pistol if an unauthorized person attempts to fire the pistol. The invention teaches that this object can be accomplished by the features disclosed hereinbelow.

SUMMARY OF THE INVENTION

A pistol locking mechanism is provided for reversibly locking the trigger mechanism of a pistol if an attempt is made by an unauthorized person to fire the pistol. The locking mechanism comprises an identification unit to detect an identification signal; a control unit connected with the identification unit that compares the inputted signal with a stored identification code or number; an actuator device having a motor, e.g., a geared motor, connected to the control unit which is connected, e.g., by a threaded spindle-nut connection, with a mechanical locking element movable between a locked position locking the trigger tongue of the pistol and an unlocked position; a battery is preferably present to supply power to the locking mechanism; and a plurality of display elements to display the operating status of the locking mechanism.

BRIEF DESCRIPTION OF THE DRAWINGS

The invention is explained in greater detail below with reference to the exemplary embodiments illustrated in the accompanying drawings, in which.

DESCRIPTION OF THE PREFERRED EMBODIMENTS

For purposes of the description hereinafter, spacial terms such as "left", "right", etc. shall relate to the invention as it is oriented in the Figures. However, it is to be understood that the invention may assume various alternative variations, except where expressly specified to the contrary.

Figure 1:
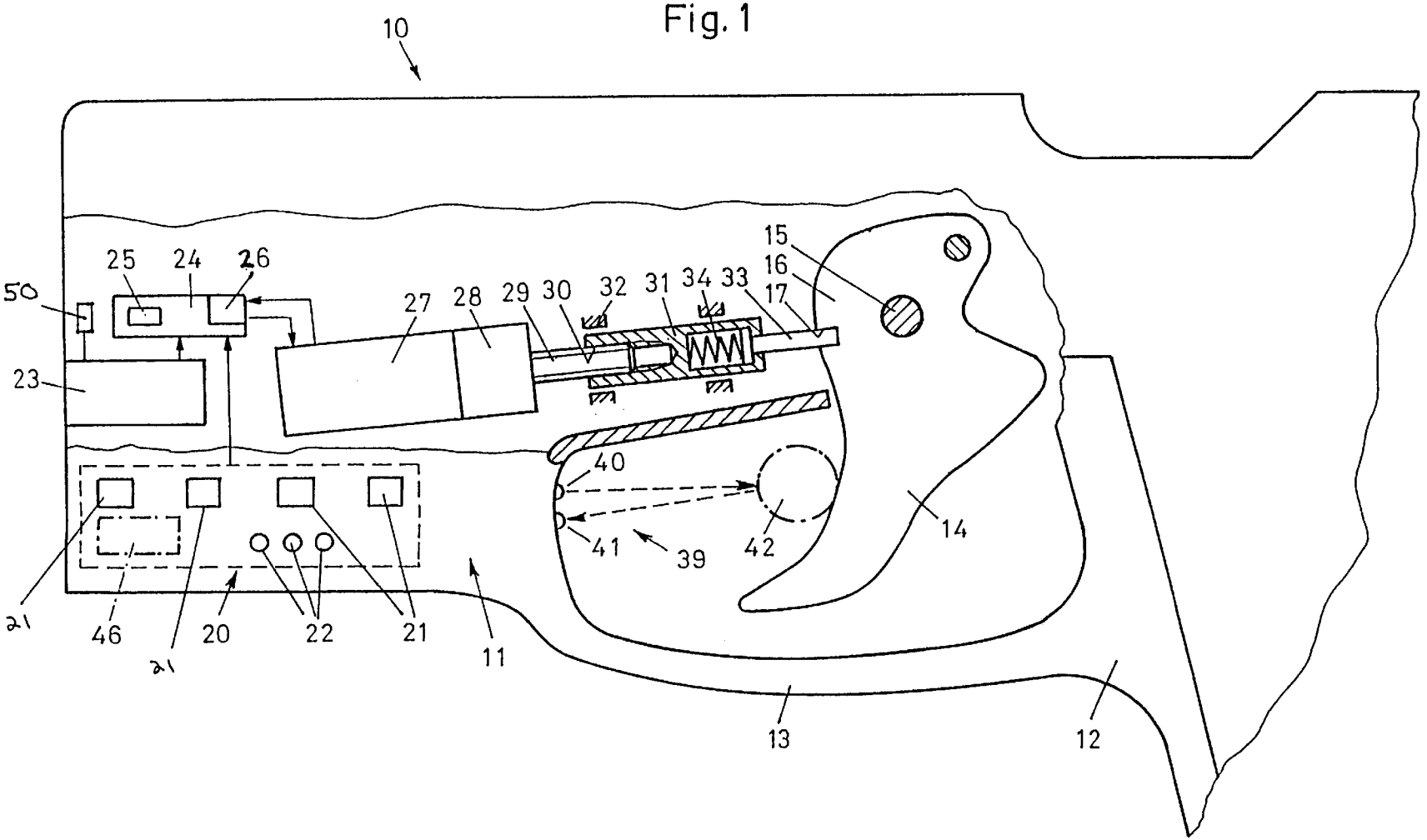
FIG. 1 shows a schematic side view of a first embodiment of the invention in partial section.

FIG. 1 is a schematic illustration showing in partial section a detail of a side view of a pistol 10 with a locking mechanism 11 of the invention. The pistol 10 has a grip body 12 with a molded trigger guard 13 into which a trigger tongue 14 projects. The tongue 14 is rotationally mounted on a cross pin 15 and actuates a trigger rail (not shown) in conventional manner. The front of the tongue 14 has an approximately cylindrical part 16 that runs concentric to the pin 15 and has an index notch 17. The locking mechanism 11 is preferably installed below the barrel and for the most part in front of the trigger guard 13.

The mechanism 11 comprises an identification unit 20 having a keypad with a plurality, e.g., four, keys 21. One key, e.g., the first or rightmost key, can be used to electronically enter signals, e.g., numbers, e.g., 1, 2 or 3 by pressing it once, twice or three times, respectively. The next two keys 21 can be used to enter or code the numbers 4 to 6 and 7 to 9, respectively. The fourth or leftmost key 21 can be used to enter the number 0 and to select the functions "reset" and "save". The mechanism 11 is preferably initially turned on by pressing any key. Pressing the fourth key 21 (reset) twice locks the trigger tongue 14 and switches the electronic system to standby. The keys 21 can be used to enter a user personal identification number (PIN) code or alphanumeric code. The user can also select the length of time the pistol will remain unlocked. After the expiration of the unlocked period or when the pistol is deactivated, the trigger mechanism is locked automatically. The identification unit 20 is in electronic communication, e.g., by wires or electronic circuit, with a power source, e.g., a battery 23, to supply electrical power to the identification source 20. The battery 23 is also in electronic communication with a charge monitoring unit 50 for monitoring the charge remaining in the battery.

The identification unit 20 preferably has three light-emitting diodes 22 of different colors to indicate the operating status of the mechanism 11. For example, one diode 22 lights when the mechanism 11 is activated and the trigger tongue 14 is locked. The second diode 22 lights when the trigger tongue 14 is unlocked. The third diode lights when the battery 23 needs to be replaced, because its charge is almost depleted. In the absence of a timely response to this signal, before the battery 23 is fully discharged and depending on the application in which the pistol is being used, the mechanism 11 switches either to lock the trigger tongue 14 (for civilian use) or to unlock the trigger tongue 14 for an unlimited period of time (for police use) when the battery power drops below a preset, specified value.

The identification unit 20 is in electronic communication with a control unit 24 having an electronic memory 25 which stores the code that must be entered to unlock the trigger tongue 14, The control unit 24 compares the code that has just been inputted into the identification unit 20 with the code stored in the memory 25. If the codes match, the control unit 24 actuates an actuator device, e.g., an electric motor 27, via an electronic control system 26. The battery 23 is also in electronic communication with the control unit 24 and motor 27 to supply electrical power to these elements. In a preferred embodiment, the motor 27, via a planetary reduction gear train 28, drives a threaded spindle 29 that is screwed into a nut thread 30 of a prismatic bolt 31. The bolt 31 is guided in guides 32 so that it can move longitudinally but non-rotationally. A locking element 33 is movably mounted in the bolt 31. The locking element 34 is biased toward the tongue 14 by a spring 34. When the tongue 14 is in a base position and the mechanism 11 is in the locked position, the locking element 33 is engaged in the notch 17 and locks the trigger tongue 14 to prevent movement of the trigger tongue 14.

If an authorized user or shooter wishes to fire the pistol 10, he first turns on the mechanism 11 by pressing one of the keys 21 and then enters his PIN code via the keys 21. The inputted code is compared by the control unit 24 to the code stored in memory 25 and, if the two codes are the same, the bolt 31 is retracted from the illustrated locked position, e.g., right most position in FIG. 1, by the motor 27 so that the locking element 33 is retracted from the notch 17 to release the trigger tongue 14, i.e., allow the trigger tongue 14 to rotate.

In addition, an infrared sensor 39 with an infrared emitter 40 and a receiver 41 can be installed on the front end of the trigger guard 13 and powered in conventional manner by the battery 23. The sensor 39 is in electronic communication with the control unit 24 and releases the control unit 24 to unlock the pistol 10 only if, before the code is entered via the keys 21, one of the shooter's fingers 42 is engaged in the trigger guard 13. When the shooter's finger 42 is removed from the trigger guard 13, the signal from the sensor 39 brings about an automatic locking of the pistol 10 by the control unit 24. Therefore if the pistol 10 falls out of the shooter's hand or is taken from him, the trigger tongue 14 is locked automatically.

Instead of the keys 21, or in addition to them, the identification unit 20 can also include a fingerprint scanner 46. In that case, the memory 25 stores the pattern of a fingerprint, for right-handed shooters, for example, the tip of the index finger of the left hand. The scanned fingerprint is compared to the pattern stored in the unit 24 and, if the two prints match, the locking mechanism 11 is unlocked, i.e., the locking element 33 is withdrawn from the notch 17. This variant has the advantage of easier and faster operation. The identification is also accurate, reliable and secure, and relates to only one individual.

Figure 2:
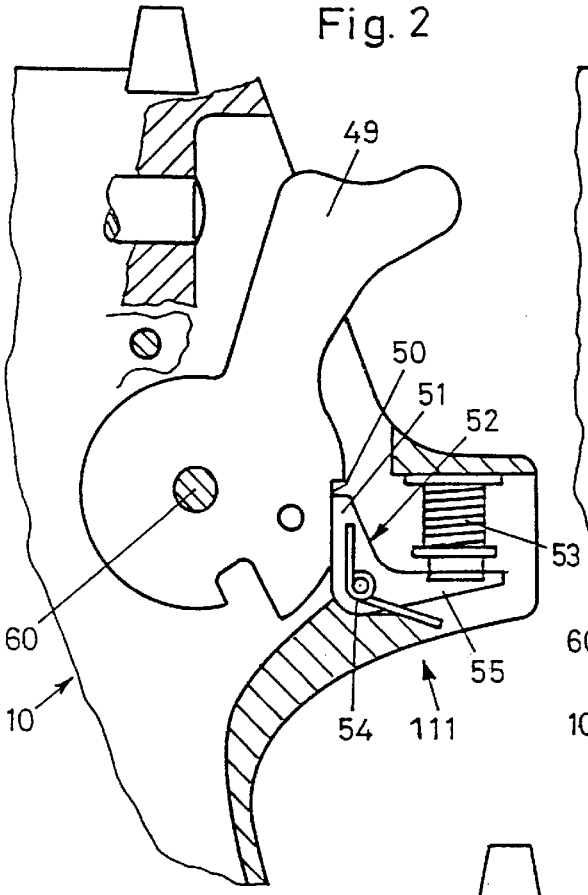
FIGS. 2 to 4 show partial sections of three additional exemplary embodiments of the invention.
Figure 3:
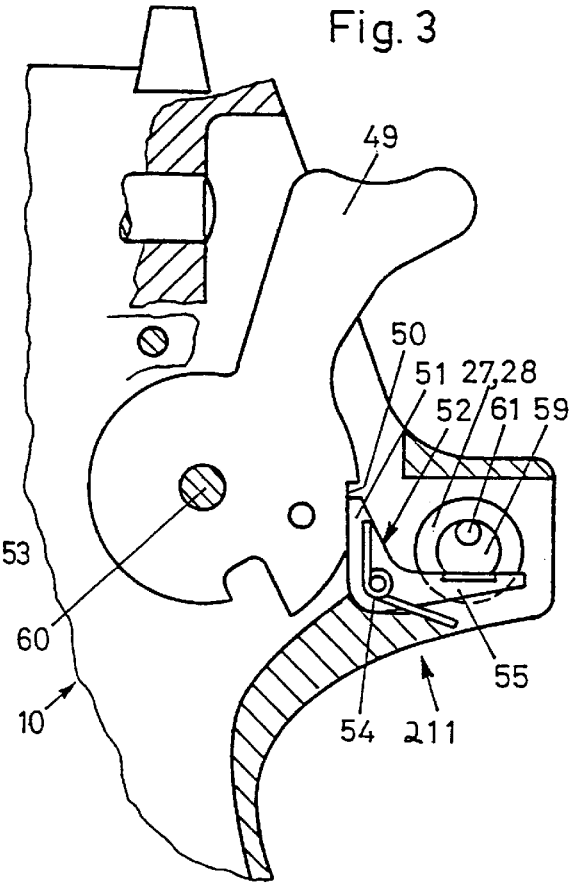
Figure 4:
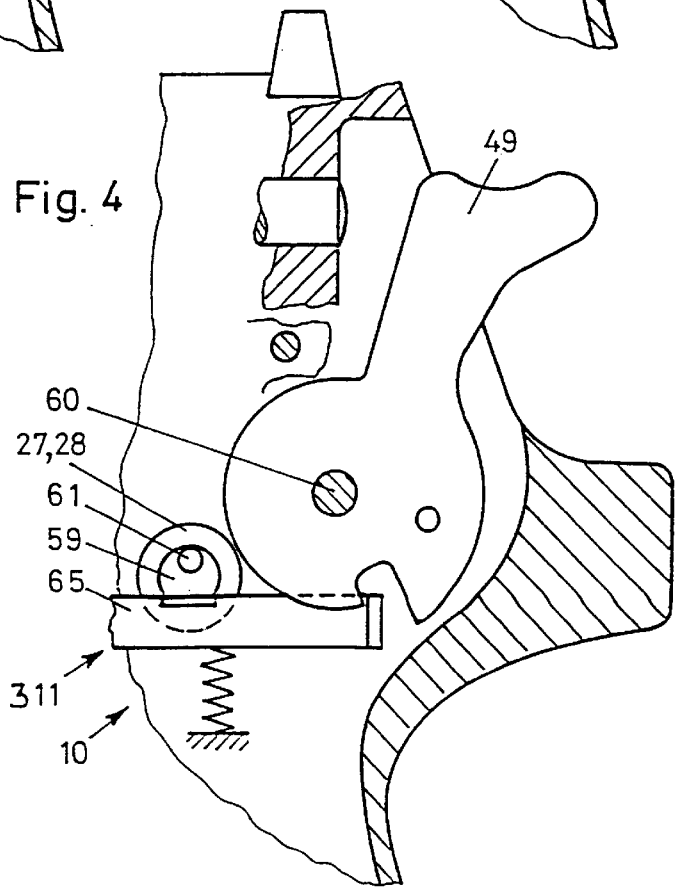

FIGS. 2 to 4 illustrate additional embodiments of the invention, whereby the elements 20 to 26 and/or 46 can be realized in a manner that is identical to the elements of the embodiment illustrated in FIG. 1. In the embodiments illustrated in FIGS. 2 and 3, a hammer 49 is locked by a locking mechanism 111. For that purpose, the hammer 49 has an index notch 50, in which, in the locked position, one, e.g., a first, arm 51 of a spring-loaded, two-armed locking lever 52 is engaged. In the mechanism 111 illustrated in FIG. 2, the lever 52 can be pivoted into the unlocked position by a solenoid 53 against the force of a spring 54. The solenoid 53 is configured to engage a second arm 55 of the lever 52. A capacitor is preferably installed in the electronic control system 26. The electronic control system 26 (FIG. 1) actuates the solenoid 53 in conventional manner, such that when the solenoid 53 is activated, the lever 52 rotates clockwise as shown in FIG. 2 so that the first arm 51 is rotated out of the notch 50 to allow the hammer 49 to be cocked.

In a locking mechanism 211 embodiment illustrated in FIG. 3, the solenoid 53 of FIG. 2 is replaced by a geared motor 27 and gear train 28 as shown in FIG. 1 having an output shaft 59 oriented substantially parallel to an axis of rotation 60 of the hammer 49. The output shaft 59 supports an eccentric pin 61. In the unlocked position, the pin 61 presses on the second arm 55 to rotate the first arm 51 out of the notch 50. This variant has the advantage that current is required only to switch from the locked position into the unlocked position and vice-versa. The shaft 59 thereby rotates by 1800 during each operation.

A locking mechanism 311 variant illustrated in FIG. 4 is analogous to the one illustrated in FIG. 3. In this case, in the locked position, the eccentric pin 61 pushes a spring-loaded trigger rail 65 out of engagement with the hammer 49 to allow the hammer 49 to be cocked.

Having described the presently preferred embodiments of the invention, it is to be understood that the invention may be otherwise embodied within the scope of the appended claims.

I claim:

1. A pistol having a locking mechanism configured to lock a trigger mechanism of the pistol if an attempt is made by an unauthorized person to fire the pistol, the locking mechanism comprising:

an identification unit configured to detect an identification signal inputted into the identification unit;

a control unit connected to the identification unit, the control unit configured to compare the signal inputted into the identification unit with a stored identification code;

an actuator device including a geared motor connected to the control unit and connected by a threaded spindle and nut connection with a mechanical locking element which is movable between a locked position and an unlocked position, wherein in the locked position the locking element locks a trigger tongue of the pistol;

a battery for supplying electrical power to the locking mechanism; and a plurality of display elements configured to display an operating status of the locking mechanism.

2. A pistol as claimed in claim 1, wherein the locking element is configured to engage a notch in the trigger tongue, and wherein the locking element is guided for movement in a bolt and is spring-loaded.

3. The pistol as claimed in claim 1, wherein at least the greater portion of the locking mechanism is located in front of a trigger guard and below the barrel of the pistol.

4. The pistol as claimed in claim 1, wherein the identification unit comprises a keypad for the input of the code.

5. The pistol as claimed in claim 1, wherein the identification unit comprises a finger-print scanner.

6. The pistol as claimed in claim 1, wherein located in front of a trigger tongue in a trigger guard of the pistol there is an infrared sensor in electronic communication with the identification unit and configured to automatically switch the actuator device into the locked position when no finger is engaged in the trigger guard.

7. The pistol as claimed in claim 1, wherein after release of the locking element, the locking element is configured to automatically move back into the locked position after one of a plurality of preselected periods of time.

8. A pistol as claimed in claim 1, wherein the locking mechanism contains a charge monitoring unit for monitoring the charge remaining in the battery, wherein this charge is indicated by one of the display elements, and wherein the locking element automatically switches into the locked position or into the unlocked position when the battery charge drops below a specified value.

9. The pistol as claimed in claim 2, wherein at least the greater portion of the locking mechanism is located in front of a trigger guard and below the barrel of the pistol.

10. The pistol as claimed in claim 2, wherein the identification unit comprises a keypad for the input of the code.

11. The pistol as claimed in claim 3, wherein the identification unit comprises a keypad for the input of the code.

12. The pistol as claimed in claim 2, wherein the identification unit comprises a finger-print-scanner.

13. The pistol as claimed in claim 3, wherein the identification unit comprises a finger-print scanner.

14. The pistol as claimed in claim 4, wherein the identification unit comprises a finger-print scanner.

15. The pistol as claimed in claim 2, wherein located in front of a trigger tongue in a trigger guard of the pistol there is an infrared sensor in electronic communication with the identification unit and configured to automatically switch the actuator device into the locked position when no finger is engaged in the trigger guard.

16. The pistol as claimed in claim 3, wherein located in front of a trigger tongue in a trigger guard of the pistol there is an infrared sensor in electronic communication with the identification unit and configured to automatically switch the actuator device into the locked position when no finger is engaged in the trigger guard.

17. The pistol as claimed in claim 4, wherein located in front of a trigger tongue in a trigger guard of the pistol there is an infrared sensor in electronic communication with the identification unit and configured to automatically switch the actuator device into the locked position when no finger is engaged in the trigger guard.

18. The pistol as claimed in claim 5, wherein located in front of a trigger tongue in a trigger guard of the pistol there is an infrared sensor in electronic communication with the identification unit and configured to automatically switch the actuator device into the locked position when no finger is engaged in the trigger guard.

19. The pistol as claimed in claim 2, wherein after release of the locking element, the locking element is configured to automatically move back into the locked position after one of a plurality of preselected periods of time.

* * * * *

UNITED STATES PATENT AND TRADEMARK OFFICE

CERTIFICATE OF CORRECTION

PATENT NO. : 6,293,039 B1
DATED : September 25, 2001
INVENTOR(S) : Rudolf Fuchs

It is certified that error appears in the above-identified patent and that said Letters Patent is hereby corrected as shown below:

Column 2,
Line 50, after "trigger 14" delete comma and insert period -- . --.

Column 3,
Line 64, "by 1800" should read -- by 180° --.

Column 4, claim 12,
Line 65, "finger-print-scanner" should read -- finger-print scanner --.

Signed and Sealed this

Nineteenth Day of March, 2002

*Attest:*

*Attesting Officer*

JAMES E. ROGAN
*Director of the United States Patent and Trademark Office*